US007208886B2

(12) United States Patent
Hsieh et al.

(10) Patent No.: US 7,208,886 B2
(45) Date of Patent: Apr. 24, 2007

(54) APPARATUS FOR DRIVING COLD CATHODE FLUORESCENT LAMPS

(75) Inventors: Kuan-Hong Hsieh, Guangdong (CN); Wei-De Bao, Guangdong (CN)

(73) Assignees: Hong Fu Jin Precision Industry (Shen Zhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/163,433

(22) Filed: Oct. 19, 2005

(65) Prior Publication Data

US 2006/0138972 A1 Jun. 29, 2006

(30) Foreign Application Priority Data

Dec. 24, 2004 (TW) ..... 93140432 A

(51) Int. Cl.
*H05B 37/02* (2006.01)
*H05B 41/36* (2006.01)

(52) U.S. Cl. ..... 315/291; 315/209 R; 315/307; 315/247; 315/219; 315/224

(58) Field of Classification Search ..... 315/312, 315/291, 209 R, 307, 219, 224, 247, DIG. 7, 315/244, 309, DIG. 5
See application file for complete search history.

(56) References Cited

U.S. PATENT DOCUMENTS

| | | | | |
|---|---|---|---|---|
| 5,343,122 | A * | 8/1994 | Sugimori et al. | 315/209 R |
| 5,363,020 | A * | 11/1994 | Chen et al. | 315/209 R |
| 6,639,367 | B2 | 10/2003 | Wells et al. | 315/224 |
| 6,703,796 | B2 * | 3/2004 | Che-Chen et al. | 315/291 |
| 6,940,733 | B2 * | 9/2005 | Schie et al. | 363/21.12 |
| 2004/0155607 | A1 | 8/2004 | Rust et al. | 315/291 |

* cited by examiner

*Primary Examiner*—Tho Phan
*Assistant Examiner*—Chuc Tran
(74) *Attorney, Agent, or Firm*—Winston Hsu

(57) ABSTRACT

A starting voltage adjustment circuit (70), which can vary starting voltages to CCFLs (40) according to variations in the temperature of the immediate environment, is employed in an apparatus for driving CCFLs. The starting voltage adjustment circuit includes a zener diode (710), a thermal resistor (720), and a voltage dividing resistor (730) connected in series between a buck converter, a resonant boost converter, and ground. The starting voltage adjustment circuit also includes a control chip (740) which includes pins, of which one is connected between the thermal resistor and the voltage dividing resistor and outputs a constant voltage, and another is connected between the voltage dividing resistor and ground. The thermal resistor has a voltage drop thereacross varying with the temperature. The starting voltage adjustment circuit adjusts an input voltage to the resonant boost converter, thereby adjusting the starting voltage to the CCFLs according to variations in temperature.

20 Claims, 2 Drawing Sheets

APPARATUS FOR DRIVING COLD CATHODE FLUORESCENT LAMPS

FIELD OF THE INVENTION

The present invention relates to an apparatus for driving lamps, and particularly to an apparatus for driving Cold Cathode Fluorescent Lamps (CCFLs).

DESCRIPTION OF RELATED ART

Fluorescent lamps are used in a number of applications where light is required but the power required to generate light is limited. One particular type of fluorescent lamp is the Cold Cathode Fluorescent Lamp (CCFL) which provides illumination in a variety of electronic devices, such as flat panel displays, computers, personal digital assistants, scanners, facsimile machines, copiers, and the like.

CCFL tubes typically contain a gas, such as Argon, Xenon, or the like, along with a small amount of Mercury. CCFLs require a high starting voltage, generally from 700–1,700 volts, for a short time at an initial ignition stage to ionize the gas contained within the CCFL tubes and ignite the CCFLs. After the gas in the CCFLs is ionized and the lamps are ignited, less voltage is required to maintain ionization.

The starting voltages of CCFLs vary with the temperature of the environment within which they operate: the higher the temperature, the lower the starting voltage. For example, when the temperature of the immediate environment is about 0 degrees Celsius, the starting voltage needed for CCFL's is approximately 1700 volts, which is significantly higher than the 1400 volts starting voltage required when the temperature is about 25 degrees Celsius. However, to avoid CCFL ignition failure from too little voltage applied in low temperature environments, conventional CCFL driving circuits provide a fixed high starting voltage (e.g., 1700 volts) to ignite the CCFL, regardless of any variation in the temperature, be it relatively high (e.g. 25° C.) or relatively low (e.g., 0° C.).

However, high starting voltages can seriously shorten the life span of CCFLs.

Therefore, what is needed is an apparatus for driving CCFLs which can provide variable voltages to ignite the CCFLs as conditions dictate in a variable temperature working environment.

SUMMARY OF INVENTION

An apparatus for driving Cold Cathode Fluorescent Lamps (CCFL) includes: a buck converter connected to a direct-current power supply; a resonant boost converter connected to the buck converter; one or more CCFLs connected to the resonant boost converter; and a starting voltage adjustment circuit connected between the buck converter and the resonant boost converter, for adjusting the starting voltage applied to the CCFLs according to the temperature of the environment within which they are operating. A feedback loop and a PWM (pulse-width modulation) control circuit are sequentially connected in series between the CCFLs and the buck converter. In addition, the PWM control circuit is also connected with the starting voltage adjustment circuit. The starting voltage adjustment circuit and the feedback loop send voltage signals to the PWM control circuit, and the PWM control circuit accordingly generates a series of PWM waves to control the power-transfer rate of the buck converter.

The starting voltage adjustment circuit comprises a control chip, and a voltage stabilizing circuit, a thermal circuit, and a voltage dividing circuit that are sequentially connected in series between the buck converter, the resonant boost converter, and ground. The voltage stabilizing circuit has one terminal connected between the buck converter and the resonant converter, and another terminal connected with the thermal circuit. The control chip includes a plurality of pins, of which a first pin is connected between the voltage stabilizing circuit and the thermal circuit, a second pin is connected between the thermal circuit and the voltage dividing circuit, a third pin is connected between the voltage dividing circuit and ground, and a fourth pin is connected to the PWM control circuit.

The second pin outputs a constant voltage U0. The thermal circuit senses the temperature of the immediate environment and adjusts a voltage drop U1 thereacross according to the reading. In addition, the voltage stabilizing circuit has a constant voltage drop Uz thereacross. Therefore, an input voltage to the resonant boost converter is equal to the sum of the constant voltage U0, the voltage drop U1, and the constant voltage drop Uz. This input varies inversely with the temperature of the immediate environment, whereby the starting voltage of the CCFLs varies inversely with such temperature.

Other advantages and novel features will be drawn from the following detailed description with reference to the attached drawings, in which:

DETAILED DESCRIPTION

Figure 1:
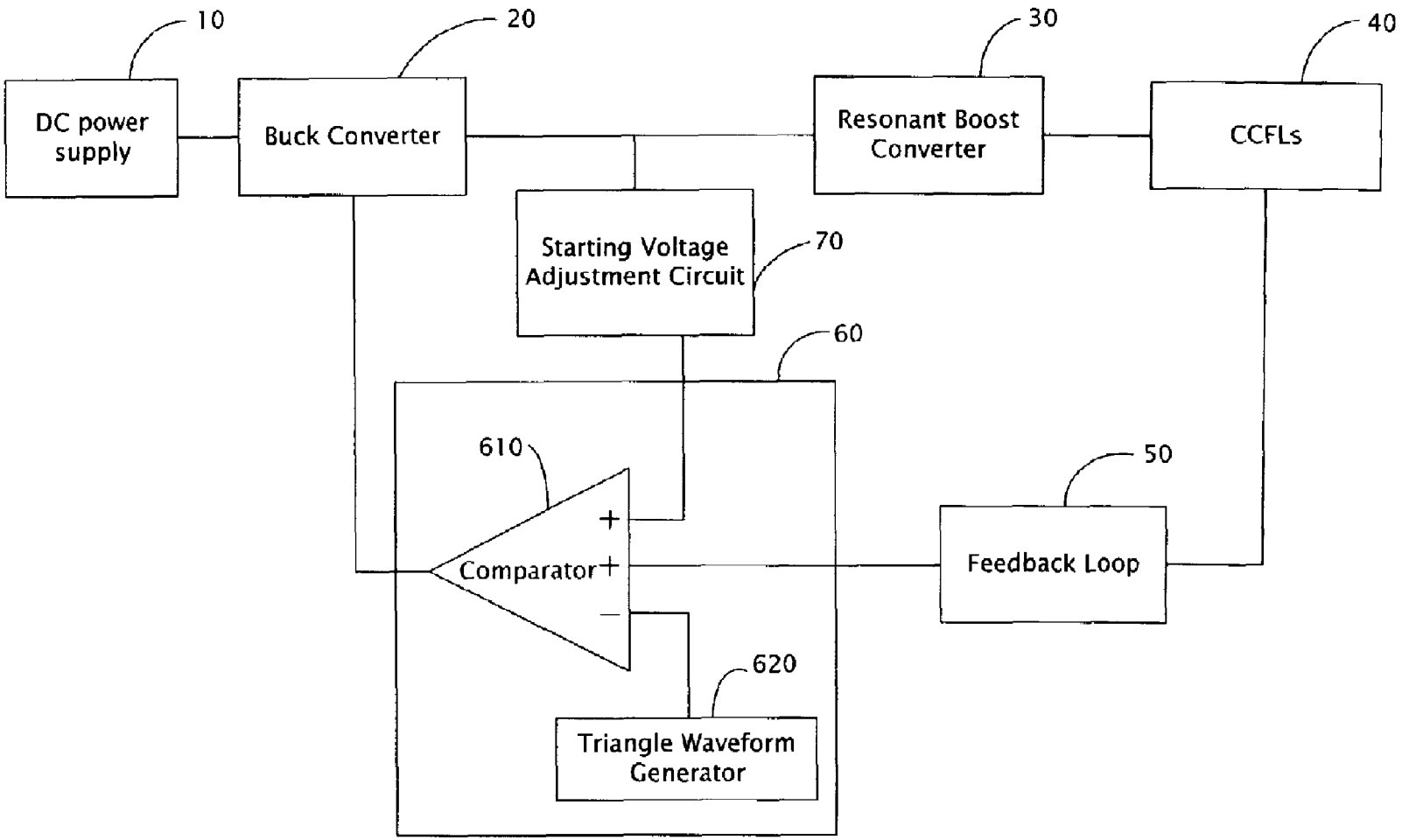
FIG. 1 is a block diagram of an apparatus for driving Cold Cathode Fluorescent Lamps (CCFLs) according to a preferred embodiment of the present invention.

FIG. 1 is a block diagram of an apparatus for driving Cold Cathode Fluorescent Lamps (CCFLs) (hereinafter, "the apparatus") according to a preferred embodiment of the present invention. The apparatus includes a buck converter 20, and a resonant boost converter 30 connected to the buck converter 20. The buck converter 20 receives power from a DC power supply 10, and transfers the power to one or more CCFLs 40 via the resonant boost converter 30. A feedback loop 50 and a PWM (pulse-width modulation) control circuit 60 are positioned sequentially between the CCFLs 40 and the buck converter 20. The PWM control circuit 60 includes a modulation signal generator and a comparator 610. In FIG. 1, the modulation signal generator is detailed as a triangle waveform generator 620. However, the modulation signal generator can be provided in any other suitable form, such as a saw-tooth waveform generator, or even a trapezoidal waveform generator. The comparator 610 includes a plurality of inputs and an output. The inputs of the comparator 610 are respectively connected to the triangle waveform generator 620, the feedback loop 50 and a starting voltage adjustment circuit 70 (described below), and the output of the comparator 610 is connected to the buck converter 20. The comparator 610 receives voltage signals from the feedback loop 50 or the starting voltage adjustment circuit 70, compares the voltage signals with modulation signals generated by the triangle waveform generator 620, and outputs a series of PWM waves to modulate the power-transfer rate of the buck converter 20 accordingly. The starting voltage adjustment circuit 70 has an input connected between the buck converter 20 and the resonant boost converter 30. In the preferred embodiment, the starting voltage adjustment circuit 70 senses variations in the temperature of the immediate environment, and adjusts input voltages to the resonant boost converter 30. In addition, the starting voltage adjustment circuit 70 outputs voltage signals according to the variations in temperature of the immediate environment to the comparator 60, whereby the comparator 60 outputs PWM waves to the buck converter 20 to modulate its power-transfer rate.

The starting voltage adjustment circuit 70 adjusts an input voltage to the resonant boost converter 30 whereby the input voltage is inversely proportional to the variation in the temperature of the immediate environment. For example, when the temperature is 0 degrees Celsius, the ignition voltage from the resonant boost converter 30 as adjusted by the starting voltage adjustment circuit 70 may be 1700 volts; alternatively, when the temperature is 25 degrees Celsius, the ignition voltage may be 1400 volts.

Figure 2:
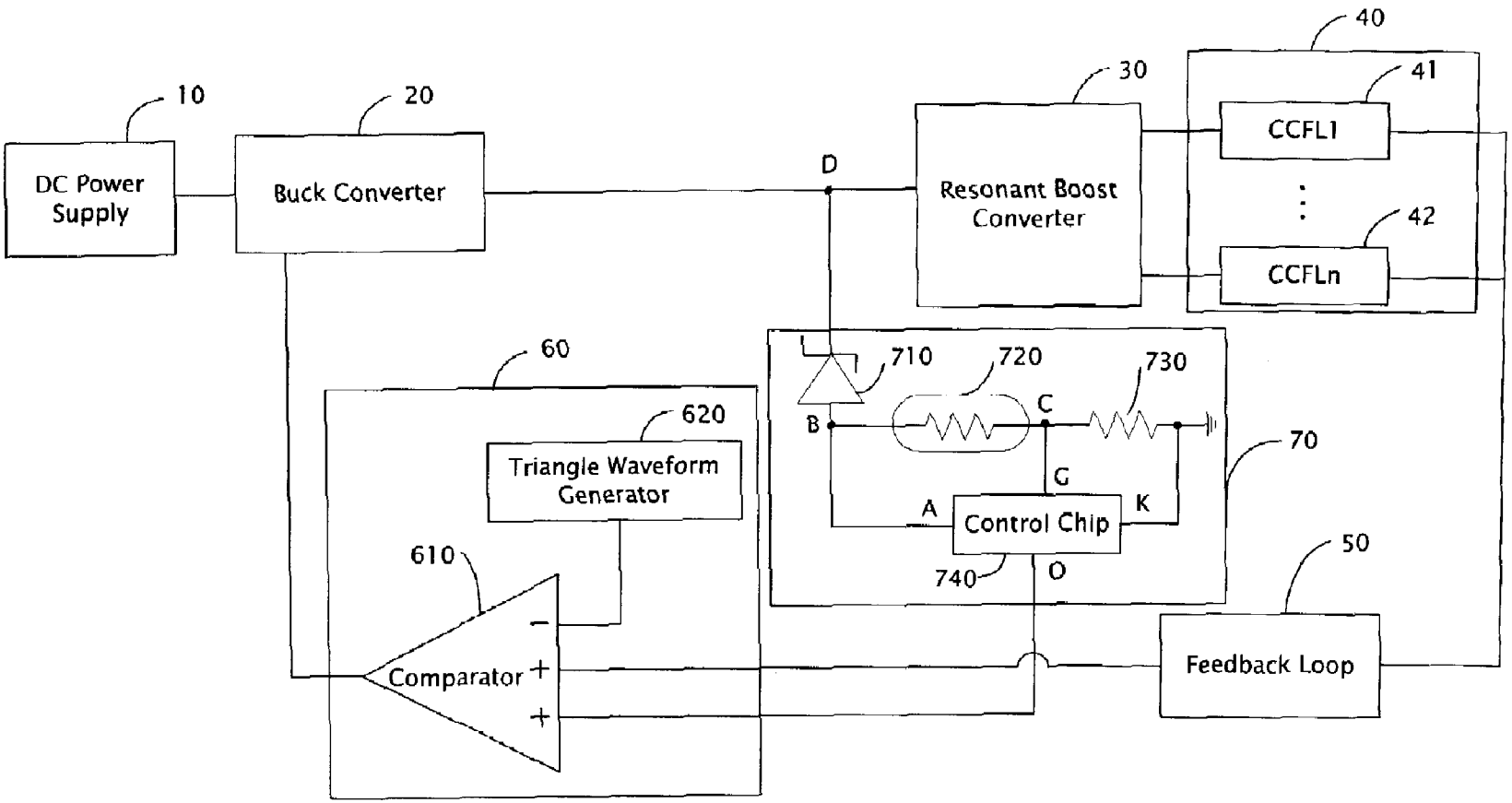
FIG. 2 is similar to FIG. 1, but showing details of an exemplary starting voltage adjustment circuit of the apparatus.

FIG. 2 is similar to FIG. 1, but showing details of the starting voltage adjustment circuit 70 in accordance with an exemplary embodiment of the present invention. The starting voltage adjustment circuit 70 includes a voltage stabilizing circuit 710, a thermal circuit 720, a voltage dividing circuit 730, and a control chip 740 having four pins (symbolically expressed as pin A, pin G, pin K, and pin O). In the illustrated embodiment, the voltage stabilizing circuit 710 is a zener diode 710 having a cathode and an anode, the thermal circuit 720 is a thermal resistor 720, and the voltage dividing circuit 730 is a voltage dividing resistor 730. The cathode of the zener diode 710 is connected between the buck converter 20 and the resonant boost converter 30, forming a common node D thereof. The anode of the zener diode 710 is respectively connected to one terminal of the thermal resistor 720 and the pin A of the control chip 740, forming a common node B thereof. The other terminal of the thermal resistor 720 is connected to one terminal of the voltage dividing resistor 730 and the pin G of the control chip 740, forming a common node C thereof. The other terminal of the voltage dividing resistor 730 and the pin K of the control chip 740 are grounded. The pin O of the control chip 740 is connected to an input of the comparator 610.

The zener diode 710 has a constant voltage drop Uz thereacross. In the preferred embodiment, the constant voltage drop Uz is preferably a little greater than an output voltage at the buck converter 20 after the CCFLs 40 have been ignited. The voltage dividing resistor 730 has a constant intrinsic resistance R2. Conversely, the thermal resistor 720 has a variable intrinsic resistance R1 that varies inversely with a change in temperature of the immediate environment. For example, when the temperature is 0 degrees Celsius, the resistance R1 of the thermal resistor 720 may be 6 ohms; and when the temperature is 25 degrees Celsius, the resistance R1 of the thermal resistor 720 may be 4 ohms.

The common node C is supplied with a constant voltage U0 from the pin G of the control chip 740. Taken together, the constant voltage U0 of the common node C, the constant resistance R2 of the voltage dividing resistor 730, and the variable resistance R1 of the thermal resistor 720 can be used in a formula to calculate a voltage U1 at the common node B, whereby U1=(R1+R2)/R2*U0. As described above, R1 varies with the temperature of the immediate environment. Therefore, correspondingly, the voltage U1 varies with the temperature as well. For example, if setting R2 equal to 2 ohms and U0 equal to 2 volts and a value for R1 of 6 ohms when the temperature of the immediate environment is 0 degrees Celsius, then the value of U1 is: (6+2)/2*2=8 volts. Further, when the temperature of the immediate environment is 25 degrees Celsius, then the resistance of R1 decreases, for example to 4 ohms, and then correspondingly the voltage U1 is: (4+2)/2*2=6 volts. The voltage U1 is supplied to the control chip 740 through the pin A, and accordingly the control chip 740 outputs voltage signals to the comparator 610 through the pin O thereof.

By function of the starting voltage adjustment circuit 70 (i.e., the zener diode 710, the thermal resistor 720, the voltage dividing resistor 730, the control chip 740, and combinations therebetween), a voltage U equal to (Uz+U1) is obtained at the common node D and is input to the resonant boost converter 30. U1 (i.e., (R1+R2)/R2*U0) varies inversely with the temperature of the immediate environment, therefore the starting voltage to the CCFLs varies inversely with the temperature as well. Accordingly, unnecessarily high ignition voltages are avoided, thereby extending the working lifetime of the CCFLs.

According to the preferred embodiment, the PWM control circuit 60 controls the power-transfer rate of the buck converter 20 pursuant to voltage signals from the control chip 740 or the feedback loop 50. At an ignition stage of the CCFLs 40, the voltage signals from the control chip 740 are received and compared with the modulation signals from the modulation signal generator at the comparator 610, and subsequently a series of PWM waves are produced in accordance with a comparison result to control the power-transfer rate of the buck converter 20. After the CCFLs 40 have been ignited, the voltage signals from the feedback loop 50 are received and another series of PWM waves are produced at the comparator 610, to control the power-transfer rate of the buck converter 20.

In FIG. 2, the CCFLs 40 are shown as including a CCFL1 41, and a CCFLn 42 (remark: n is a natural number equal to or greater than 2). Other (n-2) CCFLs arranged between the CCFL1 41 and the CCFLn 42 are not shown, but all n CCFLs 40 are arranged in parallel to each other. However, it is to be noted that in some applications, the CCFLs 40 may in fact include only the CCFL1 41.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An apparatus for driving Cold Cathode Fluorescent Lamps (CCFLs), comprising:

a buck converter coupled to a direct-current power supply;

a resonant boost converter connected to the buck converter;

one or more CCFLs connected to the resonant boost converter;

a starting voltage adjustment circuit connected between the buck converter and the resonant boost converter, for adjusting a starting voltage to the CCFLs according to a temperature of the immediate environment;

a feedback loop connected between the CCFLs and the buck converter, for generating voltage signals to control the buck converter; and a PWM (pulse-width modulation) control circuit positioned between the feedback loop and the buck converter, the PWM control circuit producing PWM waves to control the buck converter according to voltage signals received from the feedback loop, the PWM control circuit comprising a comparator and a modulation signal generator, the comparator comprising three inputs and an output, the inputs respectively connecting to the starting voltage adjustment circuit, the feedback loop and the modulation signal generator, and the output connecting to the buck converter.

2. The apparatus for driving CCFLs as claimed in claim 1, wherein the starting voltage adjustment circuit comprises: a voltage stabilizing circuit having one terminal connected between the buck converter and the resonant boost converter, and another terminal connected with ground; a thermal circuit connected between the voltage stabilizing circuit and ground; a voltage dividing circuit connected between the thermal circuit and ground; and a control chip connected among the voltage stabilizing circuit, the thermal circuit, the voltage dividing circuit, ground, and one of the inputs of the comparator.

3. The apparatus for driving CCFLs as claimed in claim 2, wherein the voltage stabilizing circuit, the thermal circuit, and the voltage dividing circuit are connected in series between the buck converter, the resonant boost converter, and ground.

4. The apparatus for driving CCFLs as claimed in claim 3, wherein the control chip has four pins, a first of the pins connecting between the voltage stabilizing circuit and the thermal circuit, a second of the pins connecting between the thermal circuit and the voltage dividing circuit, a third of the pins connecting between the voltage dividing circuit and ground, and a fourth of the pins connecting to one of the inputs of the comparator.

5. The apparatus for driving CCFLs as claimed in claim 4, wherein the second pin outputs a constant voltage, which can be designated as U0.

6. The apparatus for driving CCFLs as claimed in claim 5, wherein the thermal circuit senses the temperature of the immediate environment and adjusts a voltage drop, which can be designated as U1, thereacross according to the temperature.

7. The apparatus for driving CCFLs as claimed in claim 6, wherein the voltage stabilizing circuit has a constant voltage drop, which can be designated as Uz, thereacross.

8. The apparatus for driving CCFLs as claimed in claim 7, wherein the starting voltage adjustment circuit adjusts an input voltage to the resonant boost converter thereby adjusting the starting voltage to the CCFLs, the input voltage of the resonant boost converter being equal to a sum of the constant voltage U0 output by the second pin of the control chip, the voltage drop U1 across the thermal circuit, and the constant voltage drop Uz across the voltage stabilizing circuit.

9. The apparatus for driving CCFLs as claimed in claim 8, wherein the first pin of the control chip receives an input equal to a sum of the constant voltage U0 and the voltage drop U1, and outputs voltage signals to the comparator accordingly.

10. The apparatus for driving CCFLs as claimed in claim 9, wherein the PWM control circuit produces PWM waves to control the buck converter according to the voltage signals received from the control chip.

11. The apparatus for driving CCFLs as claimed in claim 7, wherein the voltage stabilizing circuit comprises a zener diode having an anode and a cathode, the anode connecting with the thermal circuit and the first pin of the control circuit, and the cathode connecting between the buck converter and the resonant boost converter.

12. The apparatus for driving CCFLs as claimed in claim 7, wherein the thermal circuit comprises a thermal resistor having a resistance, the resistance varying inversely with the temperature of the immediate environment.

13. The apparatus for driving CCFLs as claimed in claim 7, wherein the voltage dividing circuit comprises a voltage dividing resistor having a constant resistance.

14. An apparatus for driving Cold Cathode Fluorescent Lamps (CCFLs), comprising:

a buck converter connected to a direct-current power supply;

a resonant boost converter connected to the buck converter;

one or more CCFLs connected to the resonant boost converter; and a starting voltage adjusting circuit connected between the buck converter and the resonant boost converter, for adjusting a starting voltage to the CCFLs according to a temperature of the immediate environment, the starting voltage adjusting circuit comprising:

a voltage stabilizing circuit having a first terminal and a second terminal, the first terminal of the voltage stabilizing circuit having a constant voltage drop relative to the second terminal of the voltage stabilizing circuit, the second terminal being connected between the buck converter and the boost converter; and a thermal circuit having a resistance that varies inversely with the temperature of the immediate environment, and having a first terminal connected with the second terminal of the voltage stabilizing circuit and a second terminal used for receiving a constant voltage.

15. The apparatus for driving CCFLs as claimed in claim 14, wherein the starting voltage adjusting circuit further comprises a control chip, the control chip supplying the constant voltage to the second terminal of the thermal circuit.

16. The apparatus for driving CCFLs as claimed in claim 15, wherein the control chip receiving voltages at the first terminal of the thermal circuit and output voltage signals accordingly.

17. The apparatus for driving CCFLs as claimed in claim 16, wherein the control chip further comprises a voltage dividing circuit connected between the second terminal of the thermal circuit and ground.

18. The apparatus for driving CCFLs as claimed in claim 17, further comprising a PWM (pulse-width modulation) control circuit positioned between the buck converter and the starting voltage adjustment circuit and receiving the voltage signals from the control chip, the PWM control circuit producing PWM waves to control a power-transfer rate of the buck converter.

19. The apparatus for driving CCFLs as claimed in claim 18, further comprising a feedback loop connected between the CCFLs and the PWM control circuit, for generating voltage signals to the PWM control circuit.

20. The apparatus for driving CCFLs as claimed in claim 19, wherein the PWM control circuit comprises a comparator and a modulation signal generator, the comparator comprising three inputs and an output, the inputs respectively connecting to the starting voltage adjustment circuit, the feedback loop and the modulation signal generator, and the output connecting to the buck converter.

* * * * *